United States Patent [19]

Slobin

[11] 4,308,678

[45] Jan. 5, 1982

[54] TWO-DATE REMINDER

[76] Inventor: Joel B. Slobin, 2430 NW. 89th Ave., Sunrise, Fla. 33322

[21] Appl. No.: 214,575

[22] Filed: Dec. 8, 1980

[51] Int. Cl.[3] ..... G09D 3/08; G09D 3/06; G09D 3/00

[52] U.S. Cl. ..... 40/113; 40/111; 40/110

[58] Field of Search ..... 40/113, 114, 115, 111, 40/110, 495

[56] References Cited

U.S. PATENT DOCUMENTS

| | | | |
|---|---|---|---|
| 508,454 | 11/1893 | Weed | 40/113 |
| 900,310 | 10/1908 | Proctor | 40/115 |
| 1,203,386 | 10/1916 | Murray | 40/115 |
| 2,409,347 | 10/1946 | Dootson | 40/113 |
| 2,984,033 | 5/1961 | Sampson | 40/110 |
| 3,016,641 | 1/1962 | Lepinay et al. | 40/495 |
| 4,041,628 | 8/1977 | Sasson | 40/495 |
| 4,263,731 | 4/1981 | Kupperman | 40/113 |

*Primary Examiner*—Gene Mancene
*Assistant Examiner*—Michael J. Foycik
*Attorney, Agent, or Firm*—Oltman and Flynn

[57] ABSTRACT

The present invention provides a visible reminder of two dates which the user selects by rotatably adjusting at least one pair of concentric discs carrying inner and outer circular date scales which cooperate with corresponding reference marks to designate the selected dates.

10 Claims, 13 Drawing Figures

TWO-DATE REMINDER

SUMMARY OF THE INVENTION

This invention relates to a device for visually reminding the user of two different dates which he or she may want to be reminded of for one reason or another.

A principal object of this invention is to provide a novel and improved date reminder which the user can easily adjust manually to designate two important dates which he or she wants to remember.

The present date reminder comprises at least one pair of concentric, independently rotatable discs providing inner and outer circular date scales which cooperate with two reference marks. The first date to be remembered is selected by the rotational adjustment of one disc with respect to a corresponding reference mark. The second date to be remembered is selected by the separate and independent rotational adjustment of the second disc. Preferably, although not necessarily, the device has two pairs of such concentric discs, one for designating the months and the other for designating the days of the month for the two dates selected by the user. Once the dates are set, the same time interval can be maintained when changing the starting date.

Other objects, advantages and advantageous structural features of the present invention will be apparent from the following detailed description of four presently-preferred embodiments thereof, which are shown in the accompanying drawings.

Figure 1:
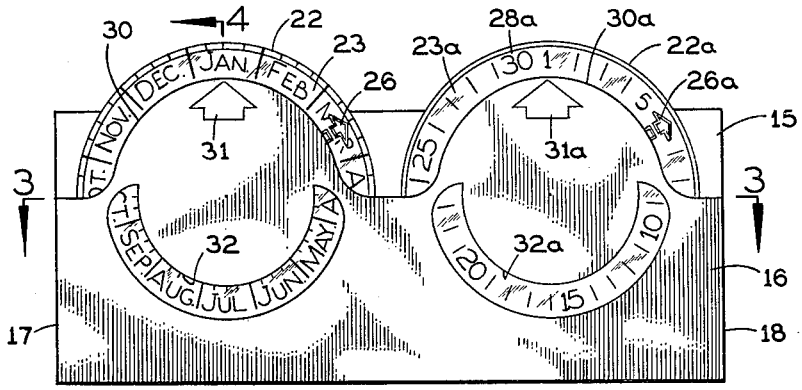
FIG. 1 is a front elevation of a first embodiment of the present invention having two pairs of discs, one for the months and the other for days of the month.
Figure 2:
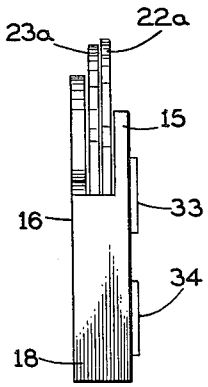
FIG. 2 is an end elevation taken from the right end of FIG. 1.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION

Referring to FIGS. 1-4, the first embodiment of the invention has a housing which includes a flat upstanding back wall 15, a flat upstanding front wall 16 extending parallel to the back wall a short distance in front of it, upstanding opposite end walls 17 and 18, a flat horizontal bottom wall 19 (FIG. 4) extending rearward from the front wall 16 at its lower end, and a flat horizontal segment 20 extending forward from the back wall 15 directly above the bottom wall 19.

Figure 4:
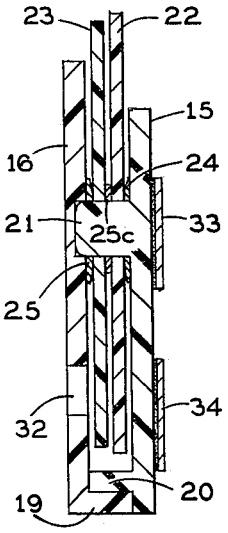
FIG. 4 is a vertical cross-section taken along the line 4—4 in FIG. 1 through the month discs.

As shown in FIG. 4, the rear wall 15 of the housing carries an integral, horizontal, forwardly projecting stem 21 of circular cross-section on which two flat, circular discs 22 and 23 are rotatably mounted in face-to-face confronting relationship. A slightly bowed annular washer 24 is engaged between the rear housing wall 15 and the rear disc 22 and a similar washer 25 is engaged between the front housing wall 16 and the front disc 23 to apply sufficient frictional restraint to keep the discs in whatever rotational position to which they have been turned. This pair of discs is located toward the left end of the apparatus in FIG. 1. There is a flat washer **25*c*** between the discs to allow them to rotate independently.

Figure 3:
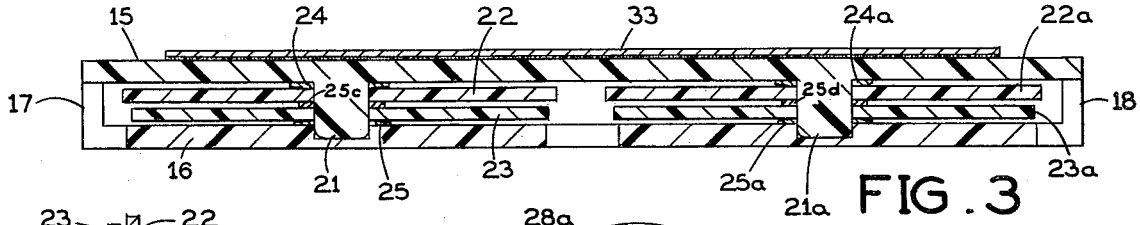
FIG. 3 is a longitudinal horizontal section taken along the line 3—3 in FIG. 1.

A similar pair of discs **22*a* and 23*a* is mounted in the same fashion near the right end of the apparatus in FIG. 1. As shown in FIG. 3, the discs of this second pair are rotatable on a stem 21*a* extending forward horizontally from the rear housing wall 15 and are frictionally restrained by washers 24*a* and 25*a*. There is a flat washer 25*d*** between the discs.

Figure 5:
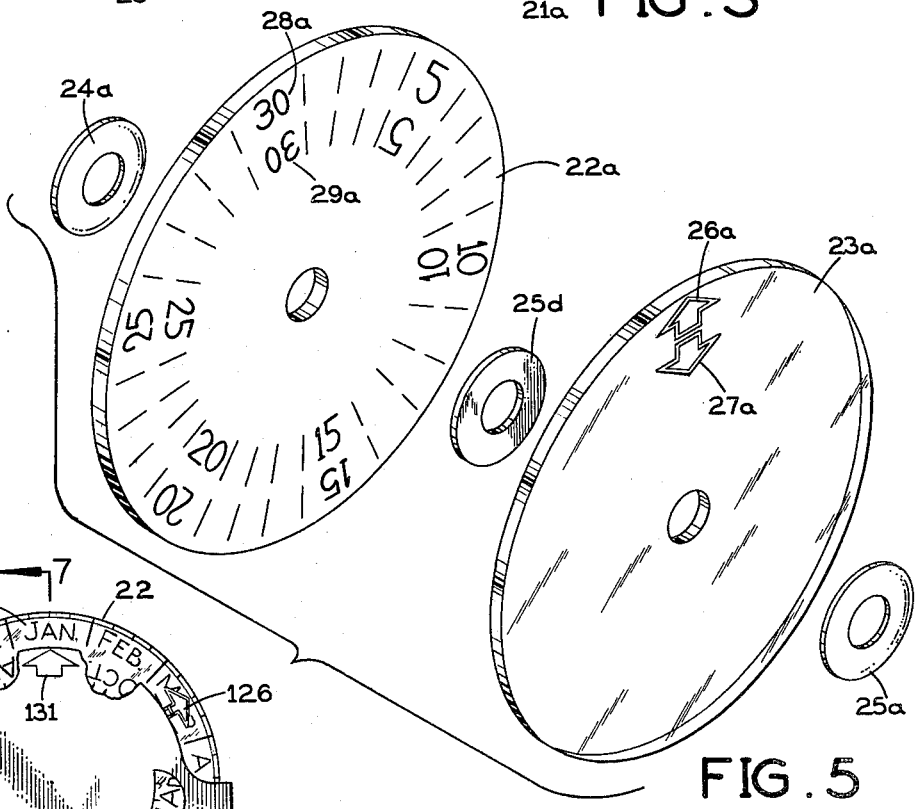
FIG. 5 is an exploded perspective view showing the day discs.

Referring to FIG. 5, the front disc **23*a* of the second pair is transparent and carries near its periphery at one circumferential location a radially outwardly pointing arrow 26*a* and a radially inwardly pointing arrow 27*a*. These two arrows constitute a reference mark for registration selectively with date indicia on the rear disc 22*a*** of this pair, as explained hereinafter.

The rear disc **22*a* carries in close proximity to its periphery a first circular series of date indicia 28*a*, which in this instance are numbers designating days of the month. Just radially inward from this first series of date indicia, the rear disc 22*a* carries a circularly arranged second series of date indicia 29*a* which are the same as the correspondingly positioned indicia of the first series, except that they are inverted. Thus, for example, the numeral "30" in the inner series 29*a* is upside down from the numeral "30" in the outer series 28*a*. The two series of date indicia 28*a* and 29*a* are concentrically arranged around the rotational axis of discs 22*a* and 23*a*** as a center.

The outer arrow **26*a* on the transparent front disc 23*a* is selectively registrable with date indicia 28*a* in the first (outer) series on the rear disc 22*a*, and the inner arrow 27*a* on the front disc is selectively registrable with date indicia 29*a*** in the second (inner) series on the rear disc.

The disc indicia for each month divides the month into four segments. Each segment could have a different color in any given month if desired.

Referring to FIG. 1, the front housing wall 16 has a substantially semicircular top edge **30*a* which extends above the inner series of date indicia 29*a* on the rear disc 22*a* and below the outer series of date indicia 28*a* on the upper half of this disc. This top edge extends through a semicircular arc above the rotational axis of discs 22*a* and 23*a* as a center. Since the front housing wall 16 is opaque, the inner series of date indicia 29*a* is not visible along the top half of the rear disc 22***a*. However, the outer series of date indicia 28*a* is visible (through the transparent front disc 23*a*) just beyond the top edge 30*a* of the front housing wall. Midway along its top edge 30*a* the front housing wall 16 represents a permanent reference mark in the form of an arrow 31*a*, which points up to the date indicium on the outer scale 28*a* which is at the "12 o'clock" position on the rotatably adjustable rear disc 22*a*. Thus, the rotational position to which the rear disc 22*a* is turned determines a first date (i.e., the date to which the arrow 31*a* points).

The front wall of the housing presents an opening or other transparent window 32 extending arcuately about 180 degrees around the conjoint rotational axis of discs 22*a* and 23*a* as a center on the opposite side of this center from the top edge 30*a*. This window extends directly in front of the inner date scale 29*a* on the bottom half of the rear disc 22*a*, and therefore these date indicia are visible through the window 32*a* and the transparent front disc 23*a*. Since the date indicia on the inner scale 29*a* are inverted, these indicia will be upright at the bottom of the rear disc 22*a*.

The transparent front disc 23*a* may be turned with respect to the housing and with respect to the rear disc 23*a* to position its outer arrow 26*a* anywhere along the upper half of the outer date scale 28*a* on the rear disc 22*a* or to position its inner arrow 27*a* anywhere along the lower half of the inner date scale 29*a* on the rear disc. In the former situation, as shown in FIG. 1, the outer arrow 26*a* and the date to which it points on the outer scale 28*a* of the rear disc are both visible just beyond the top edge 30*a* of the housing front wall 16. In the latter case, the inner arrow 27*a* and the date to which it points on the inner scale 29*a* of the rear disc are both visible through the window 32*a* in the housing front wall.

Thus, any first date may be set by rotating the rear disc 22*a* to position the selected first date on the outer date scale 28*a* in registration with the arrow 31*a* on the housing front wall 16. Then, any second date may be selected by rotating the front disc 23*a* to position its outer arrow 26*a* in registration with the selected second date along the upper half of the outer date scale 28*a* on the rear disc, if the second date is located there, or to position its inner arrow 27*a* in registration with the selected second date along the lower half of the inner date scale 29*a* on the rear disc, if the second date is located there.

Once the device is initially set no further adjustment is required. Whenever a date is set in the device it will then show the future date with the same lapse time duration. For example, if it was set for a two-month interval, when set for January 15, the future date will show March 15. When set for March 15, it should show May 15, etc. The discs rotate independently.

The same date selection arrangement is provided at the discs 22, 23 at the left side of the device in FIG. 1 as has just been described in detail for the discs 22*a* and 23*a* at the right side. Elements of the date selection arrangement at the discs 22 and 23 which correspond to those at the discs 22*a* and 23*a* are given the same reference numerals but without the "a" suffix.

The months of the first and selected dates are set by the rotatable adjustments of the discs 22, 23 and the days of the month are set by the rotatable adjustments of the discs 22*a*, 23*a*, as described.

The rear wall 15 of the housing has upper and lower magnetic "rubber" strips 33 and 34 (FIGS. 2, 3 and 4) adhesively attached to it. These strips contain permanent magnet particles dispersed in a medium of rubber or rubber-like plastic material and polarized to present North and South magnetic poles which adhere to a magnetically attractable support, such as the side or front of a refrigerator. These strips therefore enable the date reminder to be mounted in a prominent place where it is likely to be noticed by the persons concerned. Double face adhesive strips are an alternative.

Figure 6:
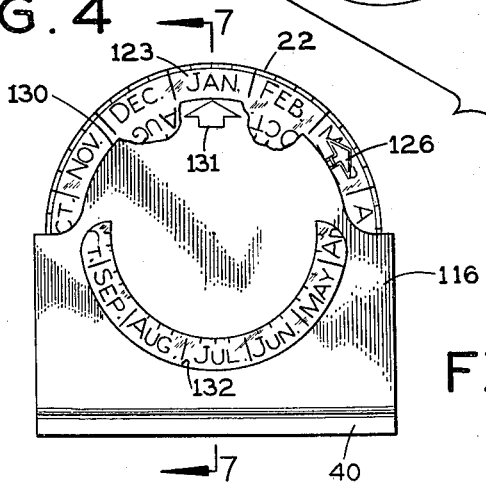
FIG. 6 is a front elevation of a second embodiment of the invention having just one pair of discs (for the months)
Figure 7:
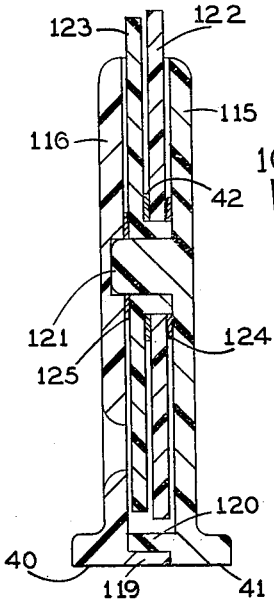
FIG. 7 is a vertical cross-section taken along the line 7—7 in FIG. 6.

FIGS. 6 and 7 show a second embodiment of the invention which is basically similar to the embodiment of FIGS. 1–5 except that it has only one pair of date discs instead of two. Elements of the device shown in FIGS. 6 and 7 which correspond to elements of the device of FIGS. 1–5 are given the same reference numerals, plus "100", and the detailed description of these elements will not be repeated.

As shown in FIG. 7, the magnetic strips are not used for mounting this device. Instead at the bottom it presents a base segment 40 projecting in front of the front wall 116 and a base segment 41 projecting behind the rear wall 115 to provide a stable base on which the device rests. Also, an additional friction washer 42 is engaged between the rear and front discs 122 and 123. In other respects the device of FIGS. 6 and 7 is essentially identical to the left half of the device of FIG. 1.

FIGS. 8–11 illustrate a third embodiment of the invention which is similar to the first in that it has two pairs of date discs, one for selecting the months of two dates and the other for selecting the days.

Figure 8:
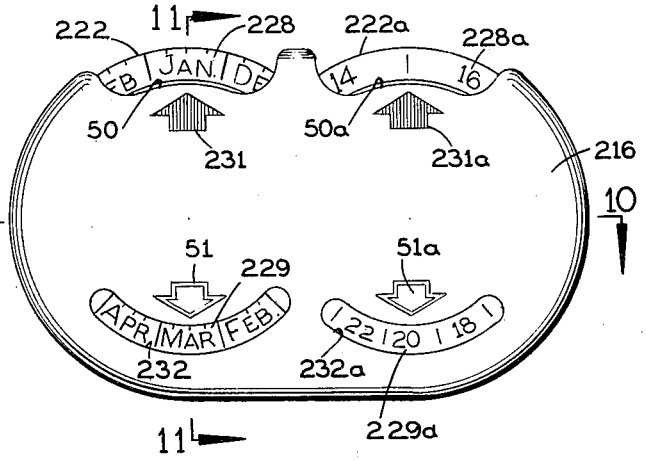
FIG. 8 is a front elevation of a third embodiment of the invention having two pairs of discs.

The front wall 216 of the housing in FIG. 8 is formed with an arcuate recess 50 at the top through which the outer date scale 228 along the top of the rear disc 222 is visible. An arrow 231 on the housing front wall points up to the date indicium on scale 228 which is at the "12 o'clock" position of disc 222.

Figure 10:
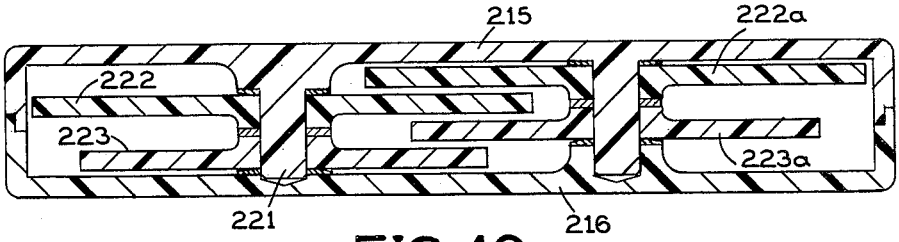
FIG. 10 is a longitudinal horizontal section taken along the line 10—10 in FIG. 8.
Figure 9:
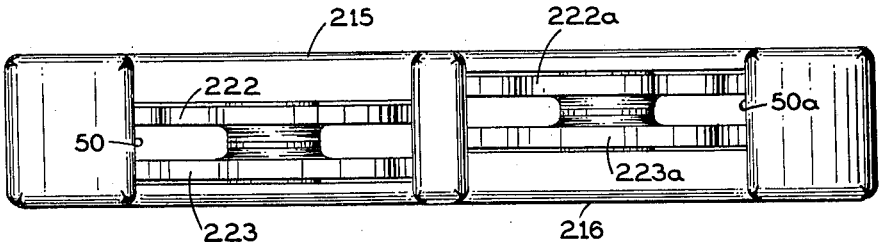
FIG. 9 is a top plan view of this embodiment.
Figure 11:
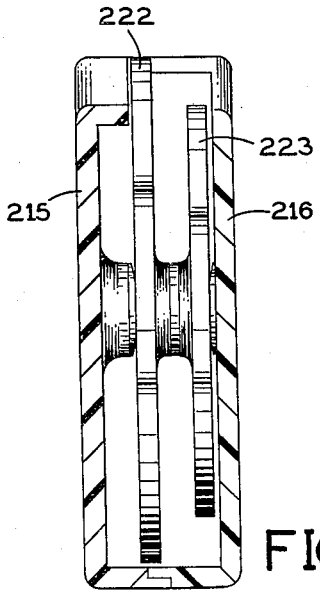
FIG. 11 is a vertical cross-section taken along the line 11—11 in FIG. 8.

As shown in FIG. 10, the front disc 223 has a substantially smaller diameter than the rear disc 222, with which it is concentric. The inner date scale 229 is on the front disc 223 near its peripheral edge instead of being on the rear disc 222. As shown in FIG. 8, at the bottom of the front disc 223 this date scale 229 is visible through an arcuate opening or window 232 formed in the housing front wall 216. An arrow 51 on the housing front wall just above the window 232 points down to the date indicium on scale 229 which is at the "6 o'clock" position of the front disc.

With this arrangement, the month of the first date is selected by rotating the rear disc 222 until the selected month registers with the top arrow 231. The month of the second date is selected by rotating the front disc 223 until this month appears at the window 232 in registration with the bottom arrow 51. Once the discs are set, they rotate together and the time interval stays the same until changed.

A similar selection arrangement is provided at the right hand pair of discs 222*a* and 223*a* in FIGS. 8 and 10, to enable selection of the days of the month. As shown in FIG. 10, the right hand discs 222*a* and 223*a* are offset from the left hand discs 222 and 223 from front to back inside the housing so that the two pairs of discs can overlap from end-to-end of the housing without interference.

Figure 12:
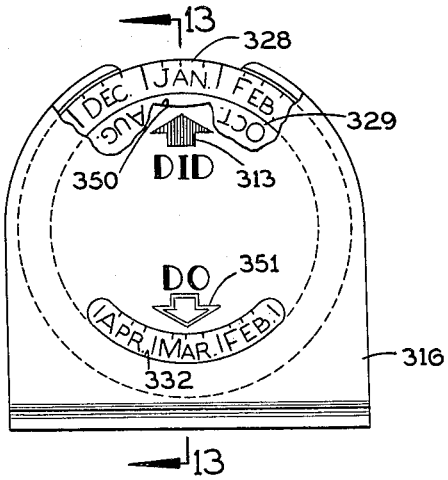
FIG. 12 is a front elevation of a fourth embodiment of the invention having just one pair of discs.
Figure 13:
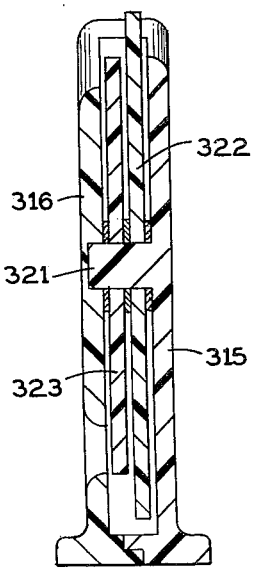
FIG. 13 is a vertical cross-section taken along the line 13—13 in FIG. 12.

FIGS. 12 and 13 show a fourth embodiment of the invention which has only one pair of discs 322 and 323, which correspond to the discs 222 and 223 on the right hand side of the device of FIGS. 8–11. The embodiment of FIGS. 12 and 13 operates in the manner already described for the discs 222 and 223 in the third embodiment. Therefore, this detailed description is unnecessary to repeat.

From the foregoing description and the accompanying drawings it will be apparent that the present invention enables the user to conveniently set two dates which he or she wants to be reminded of visually, simply by rotatably adjusting two concentric discs to bring the selected dates in registration with corresponding reference marks.

I claim:

1. A two-date reminder comprising:

a support carrying a wall which presents a fixed reference mark;

a first disc rotatably mounted behind said wall and carrying a first series of date indicia extending circularly around the rotational axis of said disc, said date indicia being movable visibly in succession past said reference mark when said first disc is turned, whereby said reference mark designates on said first series of date indicia a first date which corresponds to the rotational position to which said first disc is adjusted;

a second disc rotatably mounted behind said wall coaxial with and independent of the rotational adjustment of said first disc;

one of said discs carrying a second series of date indicia extending circularly around the rotational axis of the discs concentric with said first series of date indicia;

and means for visually designating on said second series of date indicia a second date corresponding to the rotational position to which said second disc is adjusted;

said second disc being located between said wall and said first disc;

said first disc carrying said second series of date indicia positioned concentric with and radially inward from said first series of date indicia;

said second disc being transparent and having a reference mark which is selectively registrable with date indicia on said first and second series in accordance with the rotational adjustment of said second disc with respect to said first disc;

the date indicia of said second series matching the date indicia of said first series at the same locations and being inverted with respect thereto;

said reference mark on the second disc being registrable with the first series of date indicia on the first disc at the same circumferential side of the latter as said reference mark on said wall of the support;

and said reference mark on the second disc being registrable with said second series of date indicia on the first disc at the opposite circumferential side of the latter from said reference mark on said wall of the support.

2. A two-date reminder according to claim 1, wherein:

the date indicia of said first series are visible at the top edge of said wall on the support above the rotational axis of said discs;

and said wall has a window therein below the rotational axis of the discs at which the data indicia of said second series are visible.

3. A two-date reminder according to claim 2, wherein:

said wall of the support presents substantially a semicircular top edge extending arcuately about the axis of rotation of the discs as a center, said top edge being positioned radially inward from said first series of date indicia and radially outward past said second series of date indicia;

and said window in said wall extends through substantially a semi-circle having as its center the axis of rotation of the discs.

4. A two-date reminder according to claim 3, wherein said reference mark on the second disc comprises a radially outwardly pointing arrow which registers with said first series of date indicia and a radially inwardly pointing arrow which registers with said second series of date indicia.

5. A two-date reminder according to claim 2, wherein said reference mark on the second disc comprises an arrow which overlies said first series of date indicia and an arrow which overlies said second series of date indicia.

6. A two-date reminder according to claim 1, wherein:

said reference mark on the second disc is visibly registrable with the first series of date indicia on the first disc at the same circumferential side of the latter as said reference mark on said wall of the support;

and said reference mark on the second disc is visibly registrable with said second series of date indicia on the first disc at the opposite circumferential side of the latter from said reference mark on said wall of the support.

7. A two-date reminder according to claim 6, wherein:

the date indicia of said first series are visible at the top edge of said wall on the support;

and said wall has a window therein extending arcuately downward at which the date indicia of said second series are visible.

8. A two-date reminder according to claim 7, wherein:

said wall of the support presents a substantially semicircular top edge extending arcuately about the axis of rotation of the discs as a center, said top edge being positioned radially inward from said first series of date indicia and radially outward past said second series of date indicia;

and said window in said wall extends through substantially a semi-circle having as its center the axis of rotation of the discs.

9. A Two-Date Reminder as claimed in claim 2, in which said reminder includes third and fourth discs rotatably and coaxially mounted behind said wall of the support beside said first and second discs, said third and fourth discs having respective series of indicia extending circularly around the axis of said third and fourth discs which designate days of the month, and said first and second series of date indicia designating months of the year.

10. A Two-Date Reminder comprising:

a support carrying a wall which presents a fixed reference mark;

a first disc rotatably mounted behind said wall and carrying a first series of date indicia extending circularly around the rotational axis of said disc, said date indicia being movable visibly in succession past said reference mark when said first disc is turned, whereby said reference mark designates on said first series of date indicia a first date which corresponds to the rotational position to which said first disc is adjusted;

a second disc rotatably mounted behind said wall coaxial with and independent of the rotational adjustment of said first disc;

one of said discs carrying a second series of date indicia extending circularly around the rotational axis of the discs concentric with said first series of date indicia;

and means for visually designating on said second series of date indicia a second date corresponding to the rotational position to which said second disc is adjusted;

said second disc being located between said wall and said first disc and being smaller than said first disc;

said second disc carrying said second series of date indicia concentric with and radially inward from said first series of date indicia on said first disc;

said wall of the support carrying a second reference mark spaced from said first-mentioned reference mark;

and said wall of the support having a window adjacent said second reference mark which is located radially from the rotational axis of said discs the same distance as said second series of date indicia, whereby the latter are visible through said window for registration selectively with said reference mark, depending upon the rotational position of said second disc;

said first-mentioned reference mark being at the top edge of said wall on the support above the rotational axis of the discs;

said second reference mark and said window being below the rotational axis of the discs;

said first series of date indicia having an upright orientation when aligned with said first-mentioned reference mark for readability purposes;

and said second series of date indicia being inverted relative to said first series of date indicia and having an upright orientation when aligned with said window and said second reference mark for readability purposes.

* * * * *